United States Patent [19]

Harris

[11] Patent Number: 4,932,109

[45] Date of Patent: Jun. 12, 1990

[54] CLEANING OF GAS JET YARN TREATMENT APPARATUS

[75] Inventor: Jerry C. Harris, Grifton, N.C.

[73] Assignee: E. I. du Pont de Nemours and Company, Wilmington, Del.

[21] Appl. No.: 267,061

[22] Filed: Nov. 4, 1988

[51] Int. Cl.[5] ..... D02J 1/08

[52] U.S. Cl. ..... 28/271; 28/273

[58] Field of Search ..... 28/271, 273, 276, 283; 15/302, 406

[56] References Cited

U.S. PATENT DOCUMENTS

| | | | |
|---|---|---|---|
| 29,285 | 5/1877 | Christini et al. | 428/426 |
| 3,093,879 | 6/1963 | Yamamoto | 28/72 |
| 3,115,691 | 12/1963 | Bunting, Jr. et al. | 28/1 |
| 3,262,178 | 7/1966 | Aspy, Jr. et al. | 28/273 |
| 3,574,249 | 7/1969 | Cannon | 28/1.4 |
| 4,063,317 | 12/1977 | Santore | 15/406 |
| 4,083,172 | 4/1978 | Norris et al. | 28/276 |
| 4,633,550 | 1/1987 | McAliley et al. | 28/272 |
| 4,675,957 | 6/1987 | McAliley et al. | 28/272 |

*Primary Examiner*—Werner H. Schroeder
*Assistant Examiner*—Bradley Kurtz DeSandro

[57] ABSTRACT

Apparatus for gas jet treatment of moving, continuous multifilament synthetic yarn and a method for cleaning gas jet treatment apparatus are disclosed. A pressurized gas source for the apparatus is selectively disconnected and reconnected to a conduit which supplies a gas jet orifice in a yarn treatment zone. A pressurized liquid is supplied to the conduit when the gas source is disconnected. The liquid is directed forcefully from the orifice into the yarn treatment zone to remove deposits which form during treatment of the yarns.

10 Claims, 2 Drawing Sheets

CLEANING OF GAS JET YARN TREATMENT APPARATUS

BACKGROUND OF THE INVENTION

This invention relates to the gas jet treatment of multifilament yarns and is more particularly concerned with the cleaning of deposits from apparatus employed for gas jet yarn treatment.

Continuous multifilament synthetic yarns are treated with gas jet apparatus in various yarn treatment processes such as texturing to increase the bulkiness of the yarn and interlacing to provide adequate handling characteristics to the yarn without the need for the introduction of twist to the yarn. Typically, apparatus for such gas jet treatment processes employs a pressurized gas such as air which is supplied to a jet device with a yarn treatment zone including at least one orifice which forms and directs a stream of air into the treatment zone. The yarn is conveyed through the treatment zone while being positioned with respect to the air stream to achieve the desired treatment.

In such apparatus, the flow pattern of the air in the treatment zone and the position of the yarns is usually critical to achieve the desired effect uniformly as the yarn is treated. However, deposits tend to build up on surfaces in the treatment zone which can affect the yarn treatment process. Typically, these deposits are gel-like and are composed of yarn finish solids, titanium dioxide, polymer skins and trimer which are blown off the yarns being treated. This is particularly a problem in interlace jets of the type disclosed in U.S. Pat. No. Re. No. 29,285. Such jets are provided by a number of spaced-apart, stacked ceramic plates resembling "tombstones" which have jets on one side surface and the opposite side of the plate serves as a striker surface for the jets of an adjacent plate. Yarns to be interlaced are passed in the slots between the plates and are guided by positioning pins past the jets. While a plastic comb-like device has been used to clean such apparatus, manual cleaning has not been found to be effective due to the size of the slots and the obstruction provided by the positioning pins, particularly since even small deposits left on surfaces in the treatment zone can result in non-uniform interlacing.

SUMMARY OF THE INVENTION

In accordance with the invention, there is provided an improved apparatus for gas jet treatment of moving, continuous multifilament synthetic yarns and a method for cleaning gas jet treatment apparatus. In accordance with the invention, a pressurized gas source for the apparatus is selectively disconnected and reconnected to a conduit which supplies a gas jet orifice in a yarn treatment zone. A pressurized liquid is supplied to the conduit when the gas source is disconnected. The liquid is directed forcefully from the orifice into the yarn treatment zone to remove deposits on surfaces in the yarn treatment zone which form during treatment of the yarns.

In accordance with a preferred form of the present invention, the pressurized gas is at a higher pressure than the pressurized liquid and is reconnected to the conduit with the conduit filled with the liquid so that the pressurized gas acts initially to increase the pressure of the liquid in the conduit and thereby increase the force of the liquid being directed from the orifice and then to clear the liquid from the conduit and the orifice to restore the system to normal operation.

The method and apparatus of the invention are particularly suitable for use with interlacing jets or other jet device which have small or obstructed treatment zones. Cleaning can be performed without any disassembly of the apparatus and while the yarn is running such as during doffing and no downtime is necessary. Moreover, no loss of product results from cleaning during this period since such yarn is normally discarded or separated from the standard product during doffing.

BRIEF DESCRIPTION OF THE DRAWINGS

The invention may be understood from the following detailed description illustrating a preferred embodiment of the invention which follows, reference being made to the accompanying drawings in which.

DETAILED DESCRIPTION

Figure 1:
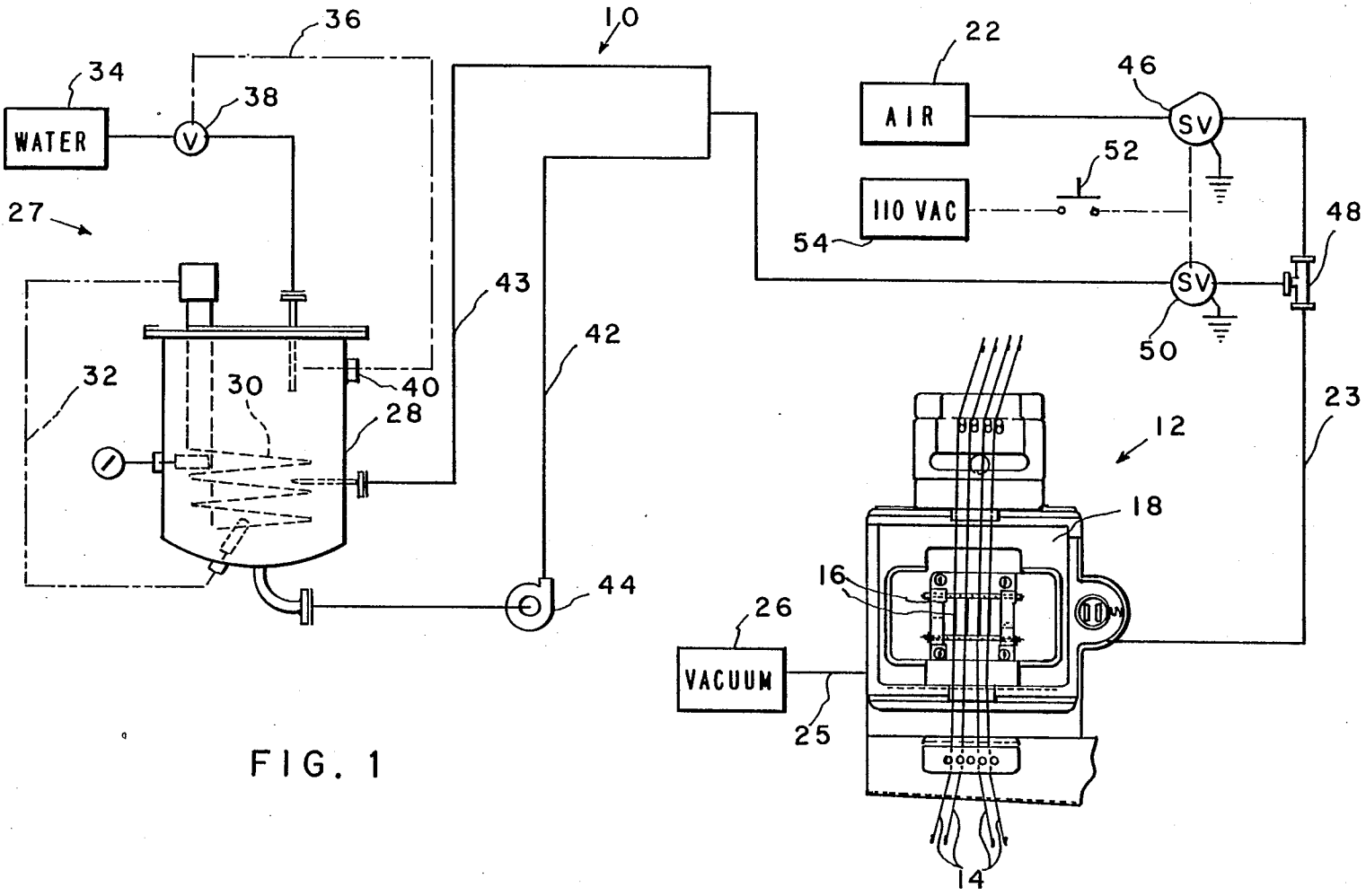
FIG. 1 is a schematic view of apparatus for the interlacing of moving, continuous multifilament synthetic yarns in accordance with the present invention including a gas jet treatment device shown with an enclosing cover removed.
Figure 2:
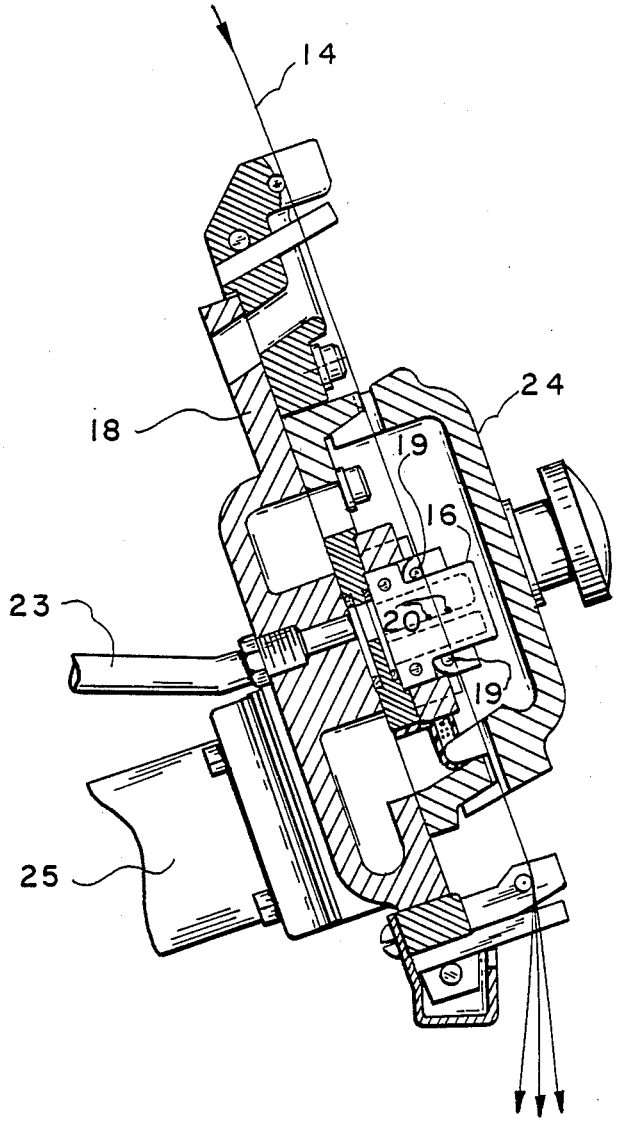
FIG. 2 is a side cross-sectional view of the gas jet treatment device employed in the apparatus of FIG. 1.

Referring now to the drawings in which like reference characters designate like or corresponding parts in FIGS. 1 and 2, FIG. 1 illustrates a preferred embodiment of apparatus 10 for the gas jet treatment of moving, continuous multifilament yarns in accordance with the present invention. Apparatus 10 includes a gas jet device 12 which provides interlacing to the four yarn threadlines 14 originating at spinning equipment (not shown) and being conveyed through the gas jet device 12. Subsequent to interlacing, the yarns are wound onto bobbins (not shown).

The gas jet device 12 provides a yarn treatment zone for each threadline in which a stream of gas such as air is employed to effect a controlled degree of entanglement or interlacing of the yarns as it moves through the zone. The gas jet device 12 depicted is of the type disclosed in U.S. Pat. Reissue No. 29,285 and U.S. Pat. No. 3,115,691, which are incorporated herein by reference. As in U.S. Pat. Re. No. 29,285, the yarn treatment zones are within slots provided by the facing surfaces of stacked, ceramic plates ("tombstones") 16 which are mounted in a spaced-apart parallel arrangement on a base 18 and the yarns run through the slots for interlacing. As is illustrated in FIG. 2, two orifices 20 in one side surface of the plates 16 provide converging streams of air directed towards the yarn in a slot. The orifices are supplied with compressed air from compressed air source 22, typically at between 35 and 95 psi depending on the desired level of interlace, by means of conduit 23 which extends from the source into the base 18 and through the plates 16. Air streams directed from the orifices 20 impinge upon the yarn and the surface of an adjacent plate 16 which serves as a striker surface during the interlacing process. For proper positioning of the yarns in relation to the air streams during interlacing, a guide pin 19 is provided directly adjacent the plates 16 above and below the slots. As shown in FIG. 2, a cover 24 encloses the area around the plates 16 and an exhaust duct 25 connected to a vacuum source 26 exhausts air from this enclosed area.

Referring again to FIG. 1, the apparatus 10 includes a liquid supply system 27 for providing liquid for cleaning one or a number of gas jet devices. Preferably, heated water is used for cleaning in accordance with the invention with water temperatures of between about 20° and about 100° C. being suitable but temperatures of between about 80° and about 95° C. are generally more effective and are preferred. Additives such as surfactants can be added to the water if desired. When the liquid is heated water, the liquid supply water system 27 includes a heated water tank 28 including a heating element and thermostatic control circuit illustrated schematically and identified as 30 and 32, respectively. The heated water tank 28 is connected to a water source 34 having a water level control circuit 36 with an appropriate solenoid valve 38 and level detector 40 so that the tank level is maintained relatively constant. Supply and return lines 42 and 43, respectively, are connected to the tank 28 to supply water for cleaning as will be described in more detail hereinafter. In order to maintain a uniform temperature of water in the tank and in the supply and return lines 42 and 43, a pump 44 circulates heated water from the tank to the supply line 42 and back to the tank by way of the return line 43. In addition, the length of any connecting lines from the supply line 42 to conduit 23 should be sufficiently short as will become apparent hereinafter so that there is not a large amount of cooler water held in such line.

For cleaning of the surfaces of the treatment zone of the gas jet device 12 in accordance with the invention, the compressed air source 22 is disconnected from the gas jet device 12 and the water is supplied instead of air so that it is directed from the orifices 20 to clean deposits from the surfaces within the treatment zone. In the preferred embodiment depicted, the air is supplied to conduit 22 through a normally open solenoid-operated valve 46. The water is connected to the conduit 22 at tee 48 with the flow of water being controlled by normally closed solenoid-operated valve 50. For actuation of the valves to begin a cleaning cycle with an air disconnect period of predetermined length, a time delay switch controlling an appropriate voltage source 54 acts to simultaneously close the normally open solenoid-operated valve 46 to shut off the compressed air and opens the normally closed solenoid-operated valve 50 to allow the flow of water into the conduit 22 for such predetermined time period.

The water can be supplied to the conduit 23 at a substantially lower pressure (e.g., 4.0 psi) than the normal interlace air provided the time delay switch keeps the normally closed solenoid-operated valve 50 open for a sufficient time for the water to fill the conduit extending from the valve 50 to the gas jet device 12. When the disconnect period is completed, the time delay switch causes the valve 50 to return to its normally closed position and the solenoid-operated valve 46 to return to its normally open position. When the pressure of the water is less than the pressure of the normal interlacing gas, the air pressure acts to increase the pressure of the liquid in the conduit. Liquid remaining in the conduit 22 is thus forced by the air pressure through the orifices 20 at a very high velocity which causes it to strike against surfaces in the treatment zone in a turbulent fashion to remove deposits from the surfaces. In addition, the air expels and clears the water from the conduit 23 and orifices 20 to restore the system to its normal condition. The exhaust duct 24 acts to carry the liquid and gel particles away from the area enclosed within the cover 19. When water heated to about 90° C. is employed, it has been found that, for example, approximately one pint of water is suitable for cleaning a jet device of the type depicted in FIGS. 1 and 2 having four threadlines.

The invention is most suitably employed during doffing when the yarns are being drawn into a sucker gun that carries the yarn into a waste container or otherwise separates the yarn from the standard product. For the embodiment depicted, the operator activates the cleaning cycle of the apparatus 10 by actuating the time delay switch 52 before new bobbins are placed on the machine. Cleaning thus takes place without the normal product being adversely affected and without disassembly or manual cleaning of the gas jet device 12. The apparatus is effectively cleaned in accordance with the invention, particularly surfaces that are obstructed from view such as by the guide pins which are in close proximity to the orifices 20 in the gas jet device.

While a preferred embodiment has been shown and described in the foregoing detailed description, it will be understood that the invention is capable of numerous modifications, rearrangements and substitution of parts without departing from the spirit of the invention as set forth in the appended claims.

I claim:

1. In apparatus for gas jet treatment of moving, continuation multifilament synthetic yarns, said apparatus including a source of pressurized gas, a body member having surfaces defining a yarn treatment zone and having at least one orifice in one of said surfaces, a conduit connected between said source of pressurized gas and said orifice so that said orifice directs a stream of gas into said yarn treatment zone, and means for positioning said yarn for movement through said yarn treatment zone for treatment by said stream of gas from said orifice, the improvement which comprises:

gas supply control means for selectively disconnecting and reconnecting said source of pressurized gas to said conduit; and liquid supply means connected to said conduit for supplying a pressurized liquid to said conduit when said gas source is disconnected, whereby said liquid is directed forcefully from said orifice into said yarn treatment zone to remove deposits on said surfaces defining said yarn treatment zone which form during treatment of said yarns without disassembly of said apparatus.

2. The apparatus of claim 1 wherein said pressurized gas is at a higher pressure than said pressurized liquid and said gas supply control means reconnects said source of pressurized gas to said conduit with said conduit filled with said liquid so that said pressurized gas acts initially to increase the pressure of the liquid in said conduit and thereby increase the force of the liquid being directed from said orifice and then to clear said liquid from said conduit and said orifice.

3. The apparatus of claim 1 further comprising actuator means for actuating said gas supply control means to disconnect the source of pressurized gas for a predetermined gas disconnect period while substantially simultaneously actuating the liquid supply means to supply liquid to said conduit during said gas disconnect period.

4. In apparatus for gas jet treatment of moving, continuous multifilament synthetic yarns, said apparatus including a source of pressurized gas, a body member having surfaces defining a yarn treatment zone and having at least one orifice in one of said surfaces, a conduit connected between said source of pressurized gas and said orifice so that said orifice directs a stream of gas into said yarn treatment zone, and means for positioning said yarn for movement through said yarn treatment zone for treatment by said stream of gas from said orifice, the improvement which comprises:

gas supply control means for selectively disconnecting and reconnecting said source of pressurized gas to said conduit; and liquid supply means for supplying a pressurized liquid to said conduit when said gas source is disconnected, whereby said liquid is directed forcefully from said orifice into said yarn treatment zone to remove deposits on said surfaces defining said yarn treatment zone which form during treatment of said yarns, said apparatus further comprising actuator means for actuating said gas supply control means to disconnect the source of pressurized gas for a predetermined gas disconnect period while substantially simultaneously actuating the liquid supply means to supply liquid to said conduit during said gas disconnect period, said actuator means comprising a time delay switch.

5. The apparatus of claim 4 wherein said gas supply control means comprises a normally open solenoid-operated valve.

6. The apparatus of claim 5 wherein said liquid supply means comprises a pressurized liquid source and a normally closed solenoid-operated valve.

7. In apparatus for gas jet treatment of moving, continuous multifilament synthetic yarns, said apparatus including a source of pressurized gas, a body member having surfaces defining a yarn treatment zone and having at least one orifice in one of said surfaces, a conduit connected between said source of pressurized gas and said orifice so that said orifice directs a stream of gas into said yarn treatment zone, and means for positioning said yarn for movement through said yarn treatment zone for treatment by said stream of gas from said orifice, the improvement which comprises:

gas supply control means for selectively disconnecting and reconnecting said source of pressurized gas to said conduit; and liquid supply means for supplying a pressurized liquid to said conduit when said gas source is disconnected, whereby said liquid is directed forcefully from said orifice into said yarn treatment zone to remove deposits on said surfaces defining said yarn treatment zone which form during treatment of said yarns, said liquid supply means supplying water heated to between about 80° and about 95° C.

8. A method for cleaning apparatus for gas jet treatment of moving, continuous multifilament synthetic yarns, said apparatus including a source of pressurized gas, a body member having surfaces defining a yarn treatment zone and having at least one orifice in one of said surfaces, a conduit connecting between said source of pressurized gas and said orifice so that said orifice directs a stream of gas into said yarn treatment zone, and means for positioning said yarn for movement through said yarn treatment zone for treatment by said stream of gas from said orifice, said method comprising:

disconnecting said source of gas from said orifice for a predetermined gas disconnect period;

providing a connection into and supplying liquid to said conduit during said gas disconnect period; and directing said liquid forcefully from said orifice into said treatment zone to remove said deposits on said surfaces of said body member which form during treatment of said yarns without disassembly of said apparatus.

9. The method of claim 8 wherein said pressurized gas is at a higher pressure than said pressurized liquid and said directing of liquid forcefully from said orifice comprises reconnecting said source of pressurized gas to said conduit with said conduit filled with liquid to initially increase the pressure of the liquid in said conduit and thereby increase the force of the liquid being directed from said orifice and then to clear said liquid from said conduit and said orifice.

10. A method for cleaning apparatus for gas jet treatment of moving, continuous multifilament synthetic yarns, said apparatus including a source of pressurized gas, a body member having surfaces defining a yarn treatment zone and having at least one orifice in one of said surfaces, a conduit connecting between said source of pressurized gas and said orifice so that said orifice directs a stream of gas into said yarn treatment zone, and means for positioning said yarn for movement through said yarn treatment zone for treatment by said stream of gas from said orifice, said method comprising:

disconnecting said source of gas from said orifice for a predetermined gas disconnect period;

supplying a liquid to said conduit during said gas disconnect period; and directing said liquid forcefully from said orifice into said treatment zone to remove said deposits on said surfaces of said body member which form during treatment of said yarns, said liquid supplied to said conduit being water heated to between about 80° and about 95° C.

* * * * *